US006935213B2

(12) United States Patent
Shu-Sui et al.

(10) Patent No.: US 6,935,213 B2
(45) Date of Patent: Aug. 30, 2005

(54) MECHANISM FOR CHANGING DIRECTION OF EXERTED FORCE OF WRENCH HAVING A RATCHET WHEEL

(75) Inventors: Lin Shu-Sui, Taichung (TW); Li Wan-Chuan, No.1, Alley 49, Lane23, Yi Chang E. Rd., Tai-Pin City, Taichung (TW)

(73) Assignees: A.A.G. Industrial Co., Ltd, Taichung (TW); Li Wan-Chuan, Taichung (TW)

( * ) Notice: Subject to any disclaimer, the term of this patent is extended or adjusted under 35 U.S.C. 154(b) by 6 days.

(21) Appl. No.: 10/759,551

(22) Filed: Jan. 16, 2004

(65) Prior Publication Data

US 2005/0155463 A1 Jul. 21, 2005

(51) Int. Cl.[7] ..... B25B 13/46

(52) U.S. Cl. ..... 81/63.2; 81/63

(58) Field of Search ..... 81/61–63, 63.1, 81/63.2

(56) References Cited

U.S. PATENT DOCUMENTS

| | | | | |
|---|---|---|---|---|
| 6,289,771 | B1 * | 9/2001 | Hsieh | 81/63 |
| 6,408,722 | B1 * | 6/2002 | Chen | 81/63.2 |
| 2003/0177872 | A1 * | 9/2003 | Shu-Ying et al. | 81/63.2 |
| 2004/0182205 | A1 * | 9/2004 | Arnold et al. | 81/63.2 |

* cited by examiner

*Primary Examiner*—Debra S Meislin
(74) *Attorney, Agent, or Firm*—W. Wayne Liauh

(57) ABSTRACT

A mechanism for changing direction of exerted force of wrench having a ratchet wheel is disclosed. In an enclosed box portion of the wrench there are provided an opening, a C-shaped seat on a bottom of the opening, the C-shaped seat having a C-shaped groove, a ratchet wheel disposed in the opening, a pawl in a first cavity, an upright swing assembly in a second cavity, and a ring for retaining the ratchet wheel in place. Counterclockwise turning the swing assembly will bias one steel ball against the pawl for engaging the pawl with the ratchet wheel, thereby causing the wrench to exert force toward a direction. Alternatively, a clockwise turning of the swing assembly will cause the wrench to exert force toward a reverse direction. Further, clockwise turning the wrench will cause the ratchet wheel to be inoperative, thereby adjusting an angle of the exerted force.

3 Claims, 15 Drawing Sheets

MECHANISM FOR CHANGING DIRECTION OF EXERTED FORCE OF WRENCH HAVING A RATCHET WHEEL

BACKGROUND OF THE INVENTION

1. Field of the Invention

The present invention relates to wrench having a ratchet wheel and more particularly to an improved mechanism for changing direction of exerted force of wrench having a ratchet wheel.

2. Description of Related Art

Mechanisms for changing direction of exerted force of wrench having a ratchet wheel are well known. For example, Taiwanese Patent Published No. 90,220,645 disclosed an enclosed box portion 1 of a wrench as shown in FIG. 1 in which in the enclosed box portion 1 there are provided a circular opening 2, a crescent cavity 3 adjacent its handle and being in communication with the opening 2, two spaced recesses 4 in a wall of the cavity 3, a ratchet wheel 5 having a central opening, the ratchet wheel 5 being fitted in the opening 2, two pawls 6 in the cavity 3, each pawl 6 having one end formed as a rotary member 8 in the recess 4, a spring 10 anchored between the wall of the cavity 3 and one side of the pawl 6 so as to bias a toothed section 8 of the pawl 6 to engage with teeth of the ratchet wheel 5, and a swing member 9 interengaged the pawls 6, the swing member 9 being adapted to move toward either side to disengage one pawl 6 from the ratchet wheel 5 responsive to a clockwise rotation or counterclockwise rotation of the wrench. Such mechanism for changing direction of exerted force of the wrench has the drawbacks of easily damaging the pawls 6, being difficult of manufacturing, and having reduced number of teeth interengaged the pawls 6 and the ratchet wheel 5.

Another Taiwanese Patent Published No. 91,201,915 disclosed an enclosed box portion 11 of a wrench as shown in FIG. 2 in which in the enclosed box portion 11 there are provided a circular opening 12, a crescent cavity 13 adjacent its handle and being in communication with the opening 12, a recess 14 in a center of a wall of the cavity 13, an inner spring 15 in the recess 14, an outer steel ball 16 in a mouth of the recess 14, a pawl 17 in the cavity 13, one side of the pawl 17 being biased by the spring depressible steel ball 16, a C-ring 18 in the opening 12, the C-ring 18 having its opening being tightly engaged with a projecting toothed section of the pawl 17, and a ratchet wheel 19 enclosed by the C-ring 18. In operation, the pawl 17 moves toward either side to engage itself with the ratchet wheel 19 or not responsive to a clockwise rotation or counterclockwise rotation of the wrench. Such mechanism for changing direction of exerted force of the wrench still has the drawbacks of having a relatively large number of components required to cooperate each other very well which in most cases cannot be obtained, and being difficult of manufacturing.

Still another Taiwanese Patent Published No. 87,205,173, A02 disclosed an enclosed box portion 1 of a wrench as shown in FIG. 3 in which in the enclosed box portion 20 there are provided a ratchet wheel 21 in a circular opening, a pawl 22 in a crescent cavity adjacent its handle and the crescent cavity being in communication with the circular opening, and a swing member 23 in a recess in a wall of the crescent cavity, the swing member 23 having a projecting, spring depressible pin 24 urged against the pawl 22 to cause the pawl 22 to engage with the ratchet wheel 21. In operation, the pawl 22 moves toward either side to engage itself with the ratchet wheel 21 or not responsive to a clockwise rotation or counterclockwise rotation of the wrench. Such mechanism for changing direction of exerted force of the wrench still has the drawbacks of having a relatively large number of components required to cooperate each other very well which in most cases cannot be obtained, being inconvenient in operation, and poor direction change of exerted force. Thus, the need for improvement still exists.

SUMMARY OF THE INVENTION

It is an object of the present invention to provide a wrench including an enclosed box portion, the enclosed box portion comprising a circular opening; a C-shaped seat on a bottom of the circular opening, the C-shaped seat having a C-shaped groove and a diameter larger than that of the circular opening; a substantially crescent first cavity provided at one side of the circular opening and being in communication therewith; a substantially half-circular second cavity adjacent a handle of the wrench and being in communication with the adjacent first cavity; a ratchet wheel provided in the circular opening; pawl means provided in the first cavity, the pawl means including a toothed section at one side and two continuous convex members at the other side; an upright swing assembly fastened in the second cavity, the swing assembly including a trigger member on a top of the enclosed box portion, two arcuate members at opposite sides, a spring in a transverse hole, and two steel balls at both ends of the spring; and ring means including an annular recess and a flexible C-ring put on the recess, the ring means being fitted onto the seat with the recess being flush with the groove so that the C-ring is adapted to resiliently expand to dispose in both the recess and the groove for retaining the ratchet wheel in place, whereby counterclockwise turning the trigger member will disengage the steel balls from the convex members to be in contact with a wall of the second cavity and disengage the pawl means from the ratchet wheel; continuously counterclockwise turning the trigger member will bias one steel ball against one convex member for engaging the pawl means with the ratchet wheel, thereby causing the wrench to exert force toward a first direction; clockwise turning the wrench will cause the ratchet wheel to be inoperative, thereby adjusting an angle of the exerted force; clockwise turning the trigger member will disengage the steel balls from the pawl means to engage with the wall of the second cavity and disengage the pawl means from the ratchet wheel; and continuously clockwise turning the trigger member will bias the other steel ball against the other convex member for engaging the pawl means with the ratchet wheel, thereby causing the wrench to exert force toward a second direction opposite to the first direction.

The above and other objects, features and advantages of the present invention will become apparent from the following detailed description taken with the accompanying drawings.

DETAILED DESCRIPTION OF THE PREFERRED EMBODIMENTS

Figure 1:
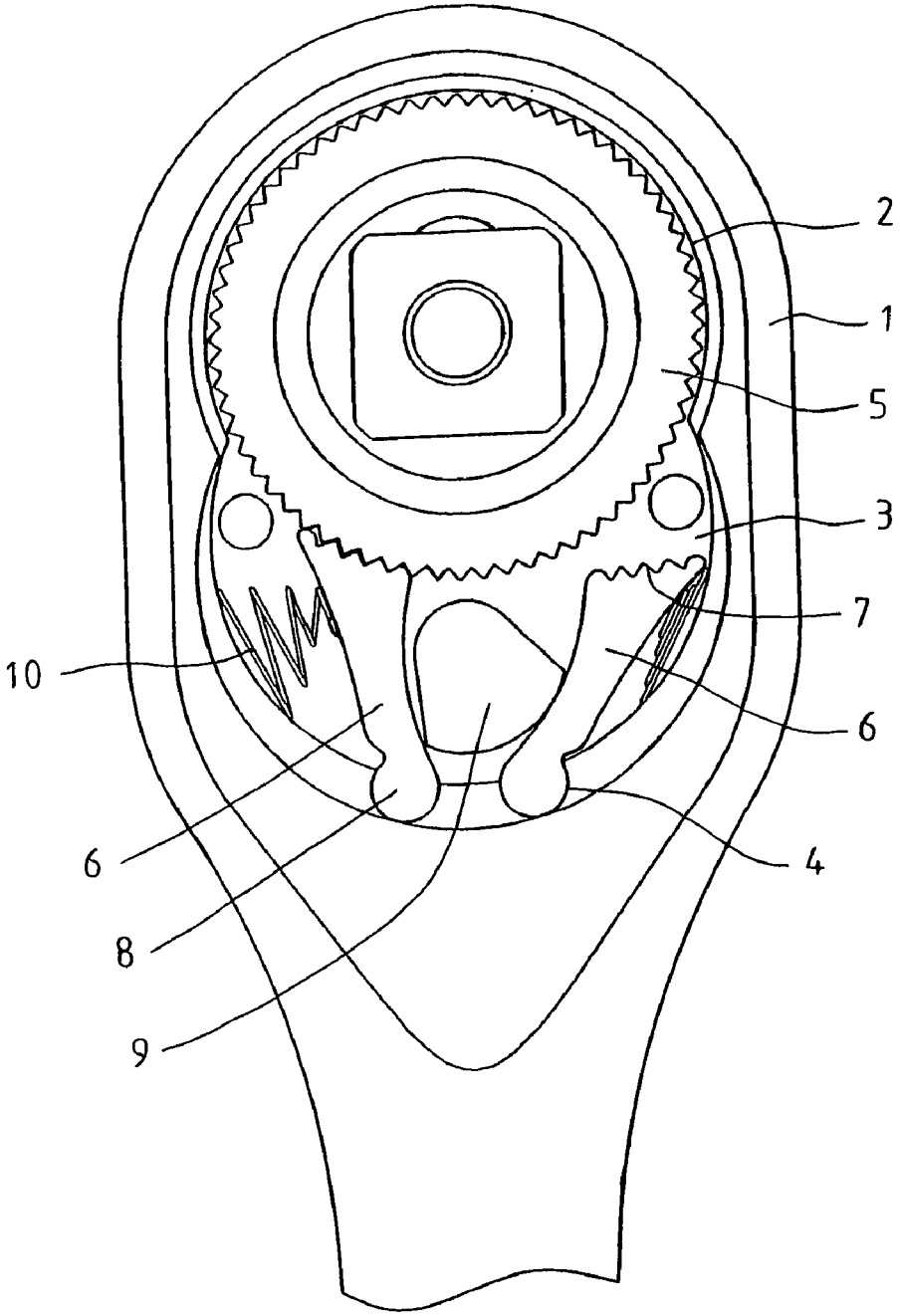
F I G . 1 PRIOR ART
FIG. 1 is a top plan view with a portion removed of a conventional wrench having a ratchet wheel in its enclosed box portion for illustration of a mechanism for changing direction of exerted force.
Figure 2:
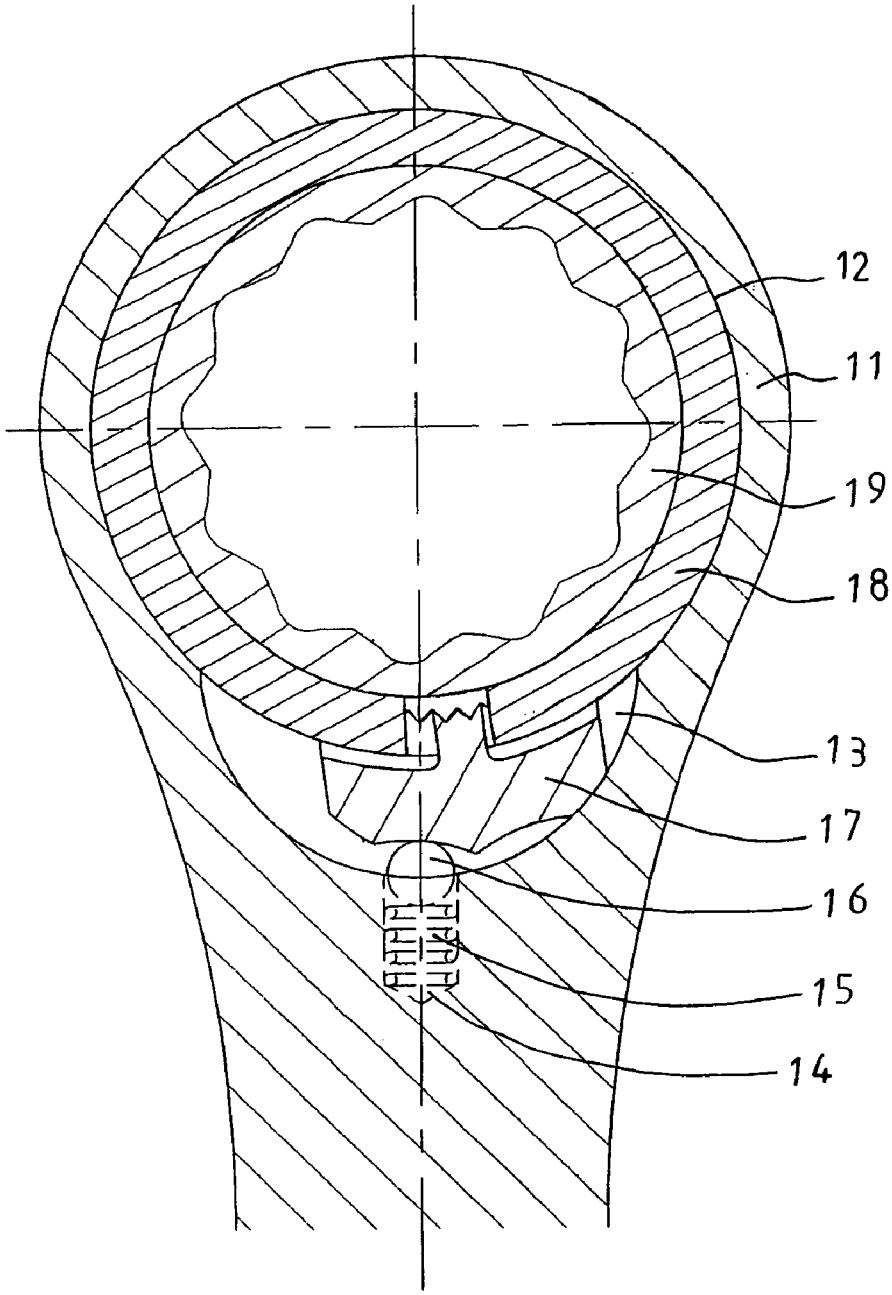
F I G . 2 PRIOR ART
FIG. 2 is a top plan view with a portion cut away of another conventional wrench having a ratchet wheel in its enclosed box portion for illustration of a mechanism for changing direction of exerted force.
Figure 3:
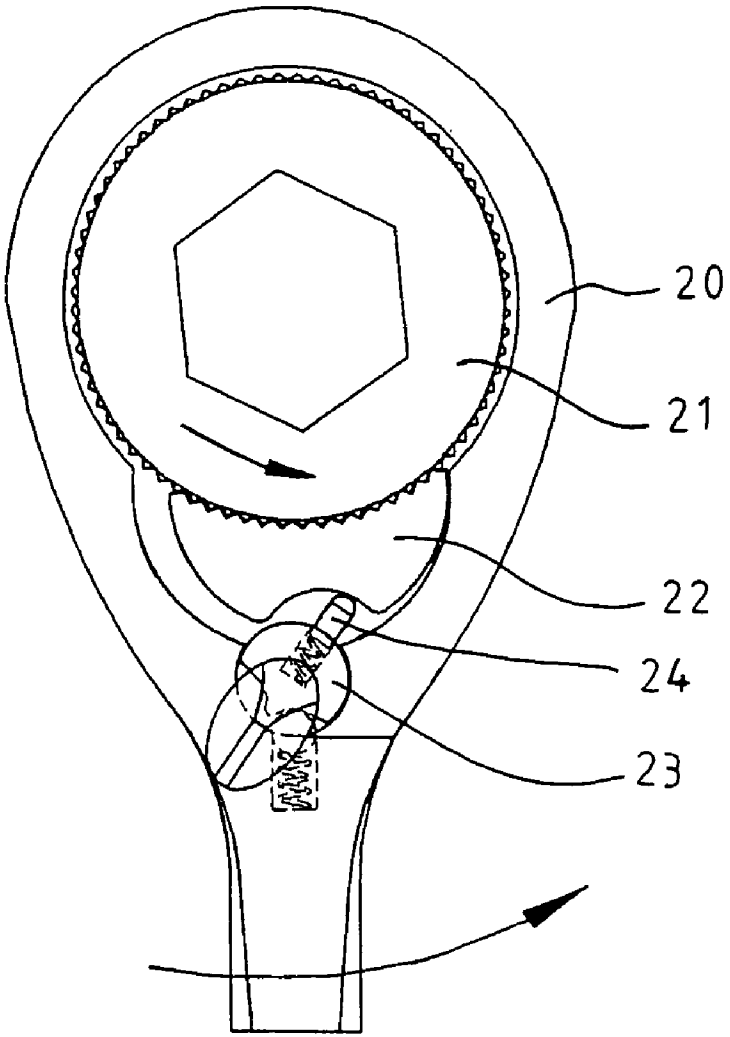
FIG. 3 PRIOR ART
FIG. 3 is a top plan view with a portion removed of still another conventional wrench having a ratchet wheel in its enclosed box portion for illustration of a mechanism for changing direction of exerted force.
Figure 4:
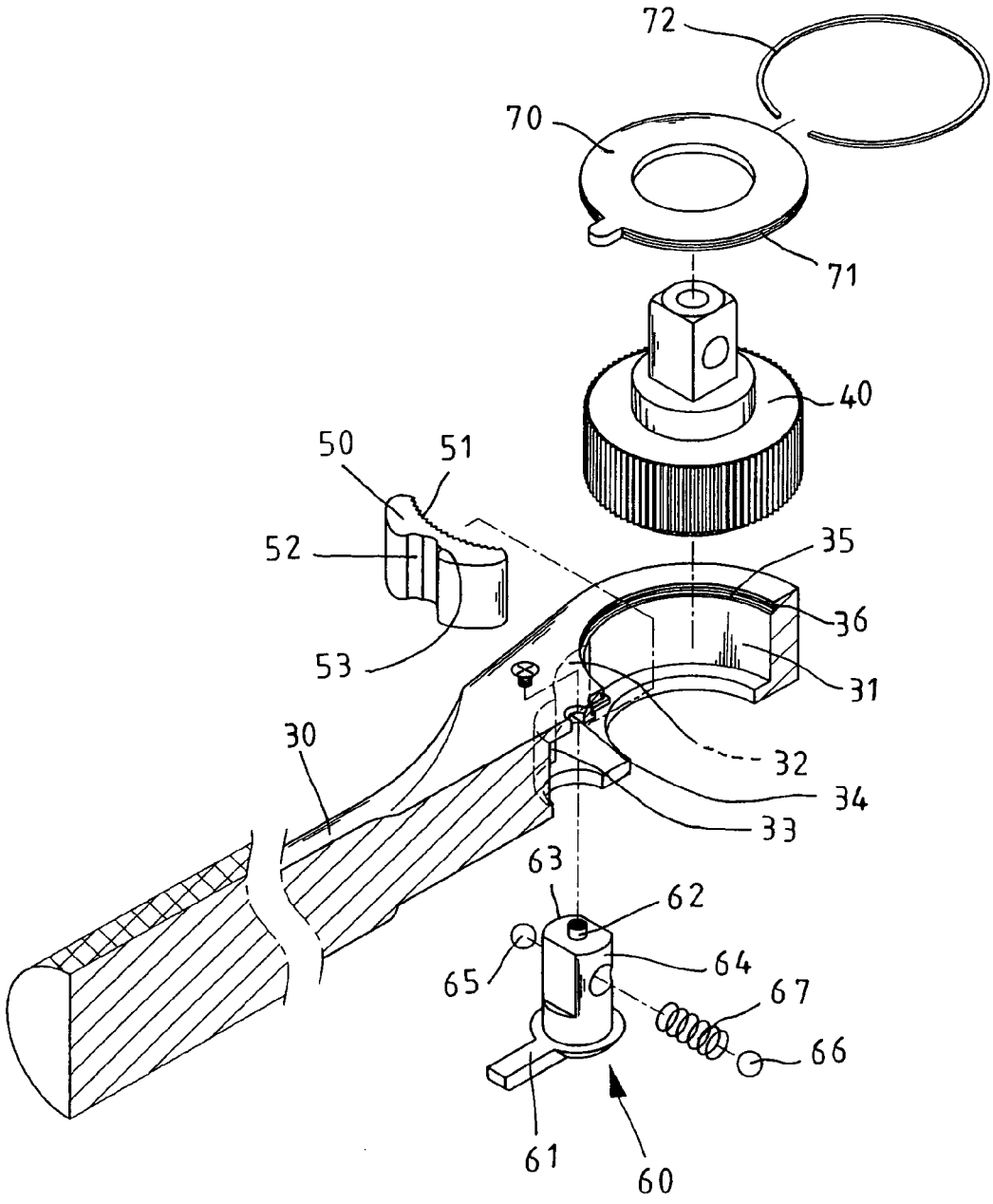
FIG. 4 is an exploded view in part section of a preferred embodiment of wrench according to the invention.

Referring to FIGS. 4 to 7, a wrench 30 constructed in accordance with the invention is shown. An enclosed box portion of the wrench 30 comprises a circular opening 31 consisting of three stages in which a lowest stage is formed as a C-shaped seat 35 having a C-shaped groove 36, the C-shaped seat 35 having the largest diameter among three stages (FIG. 7); a substantially crescent first cavity 32 at one side of the circular opening 31 and being in communication therewith; a substantially half-circular second cavity 33 adjacent a handle and being in communication with the adjacent first cavity 32; a recessed aperture 34 on a bottom of the enclosed box portion, the aperture 34 being in communication with the second cavity 33; a ratchet wheel 40 provided in the circular opening 31; a pawl block 50 provided in the first cavity 32, the pawl block 50 including a toothed section 51 at one side adapted to engage with the ratchet wheel 40, and two continuous convex members 52, 53 at the other side; an upright swing assembly 60 including an elongated trigger member 61 rested on a top of the enclosed box portion, two arcuate members 63, 64 at opposite sides, a spring 67 in a transverse hole (not numbered), two steel balls 65, 66 at both ends of the spring 67, the spring 67 being adapted to bias the steel balls 65, 66 against a wall of the second cavity 33 and/or one of the convex members 52, 53 as detailed later, a cylindrical projection 62 having inner threads inserted into the aperture 34 so that a fastener (e.g., screw) can be driven into the projection 62 for threadedly fastening the swing assembly 60 in the second cavity 33; a ring member 70 having an annular recess 71; and a flexible C-ring 72 put on the recess 71. The ring member 70 is fitted onto the seat 35 with the recess 71 being flush with the groove 36 so that the C-ring 72 is able to resiliently expand to dispose in both the recess 71 and the groove 36 for retaining the ratchet wheel 40 in place.

Figure 5:
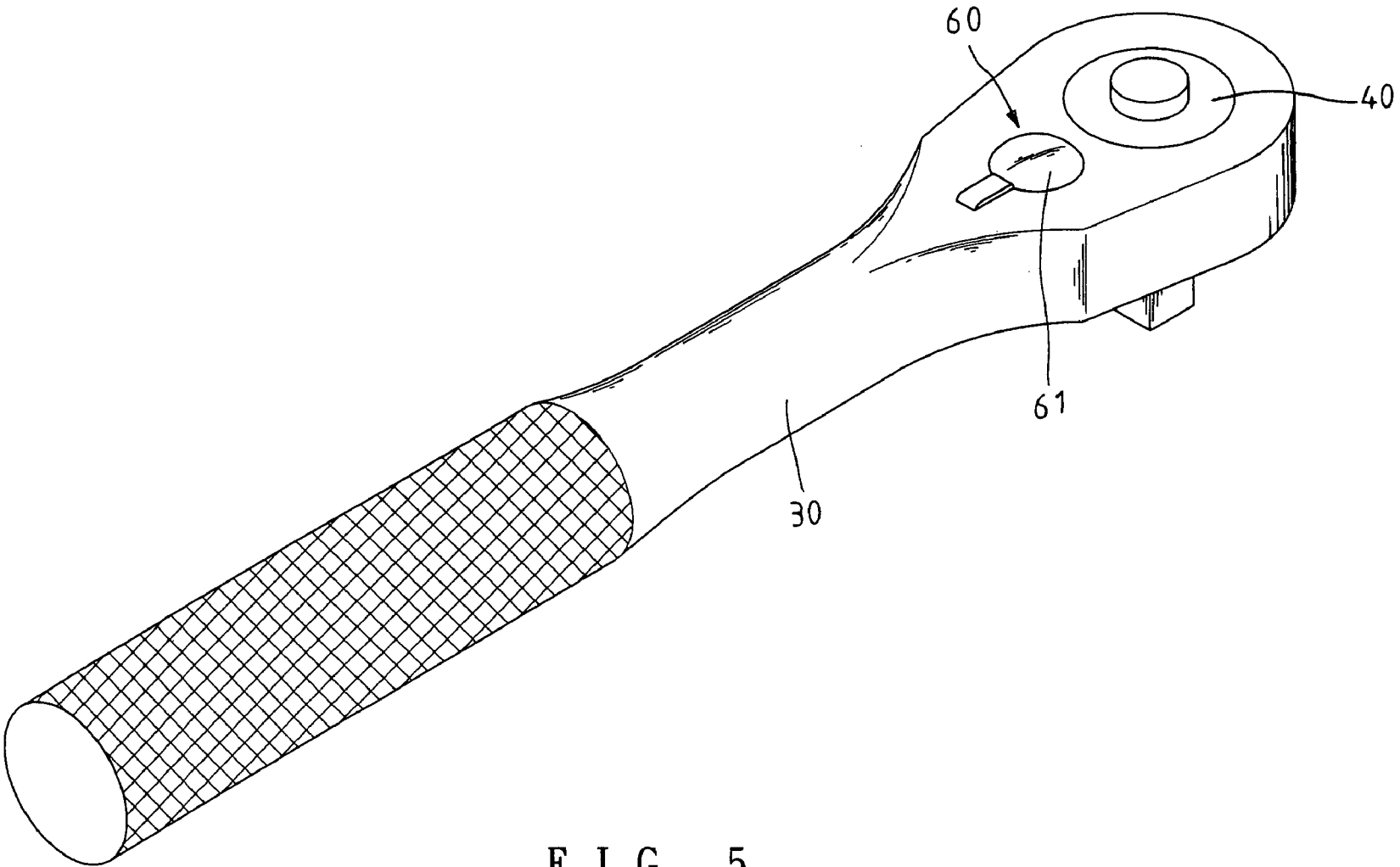
FIG. 5 is a perspective view of the assembled wrench shown in FIG. 4.
Figure 6:
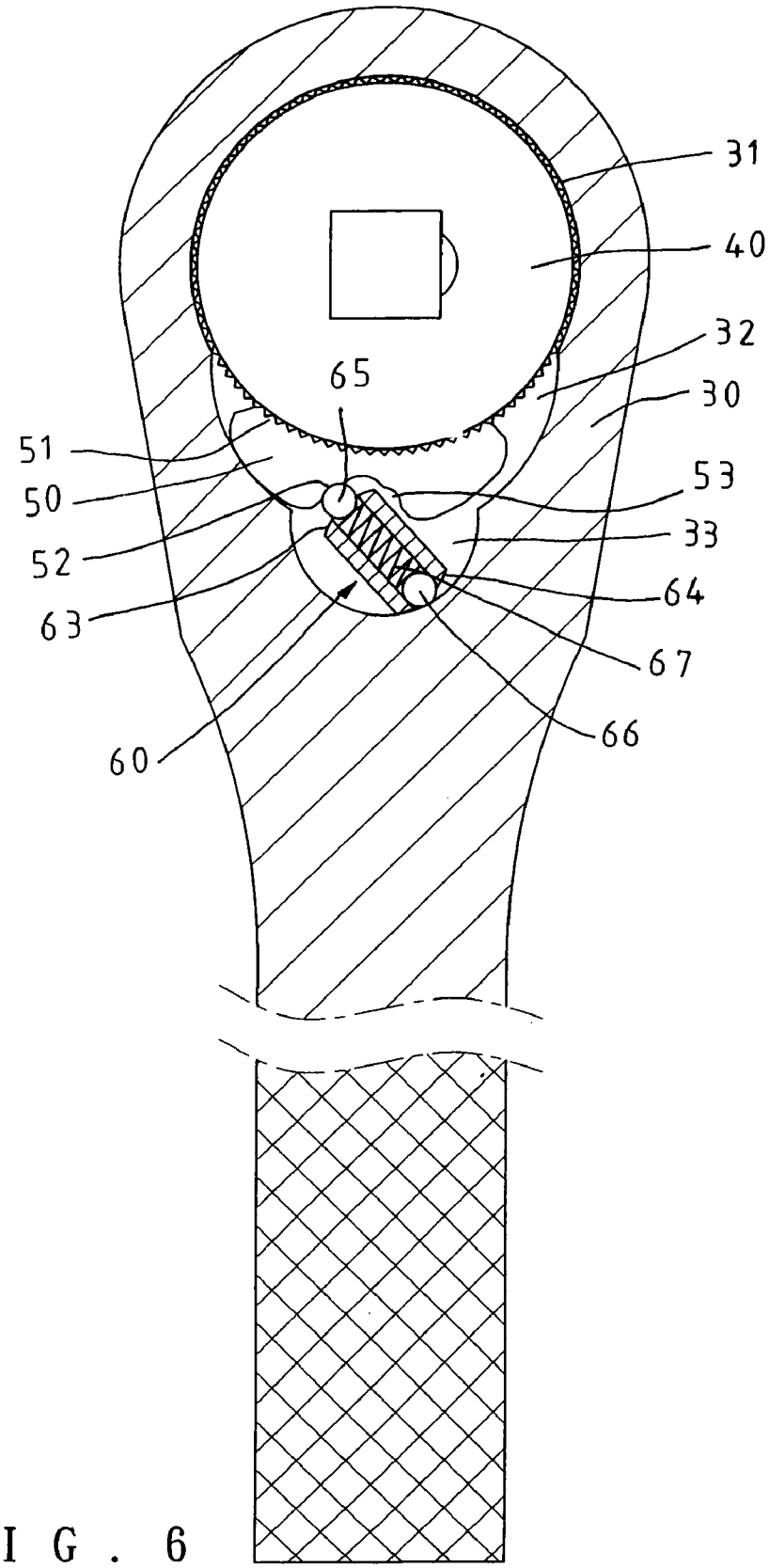
FIG. 6 is a top plan view with a portion removed of the wrench of the invention having a ratchet wheel in its enclosed box portion for illustration of a mechanism for changing direction of exerted force.
Figure 7:
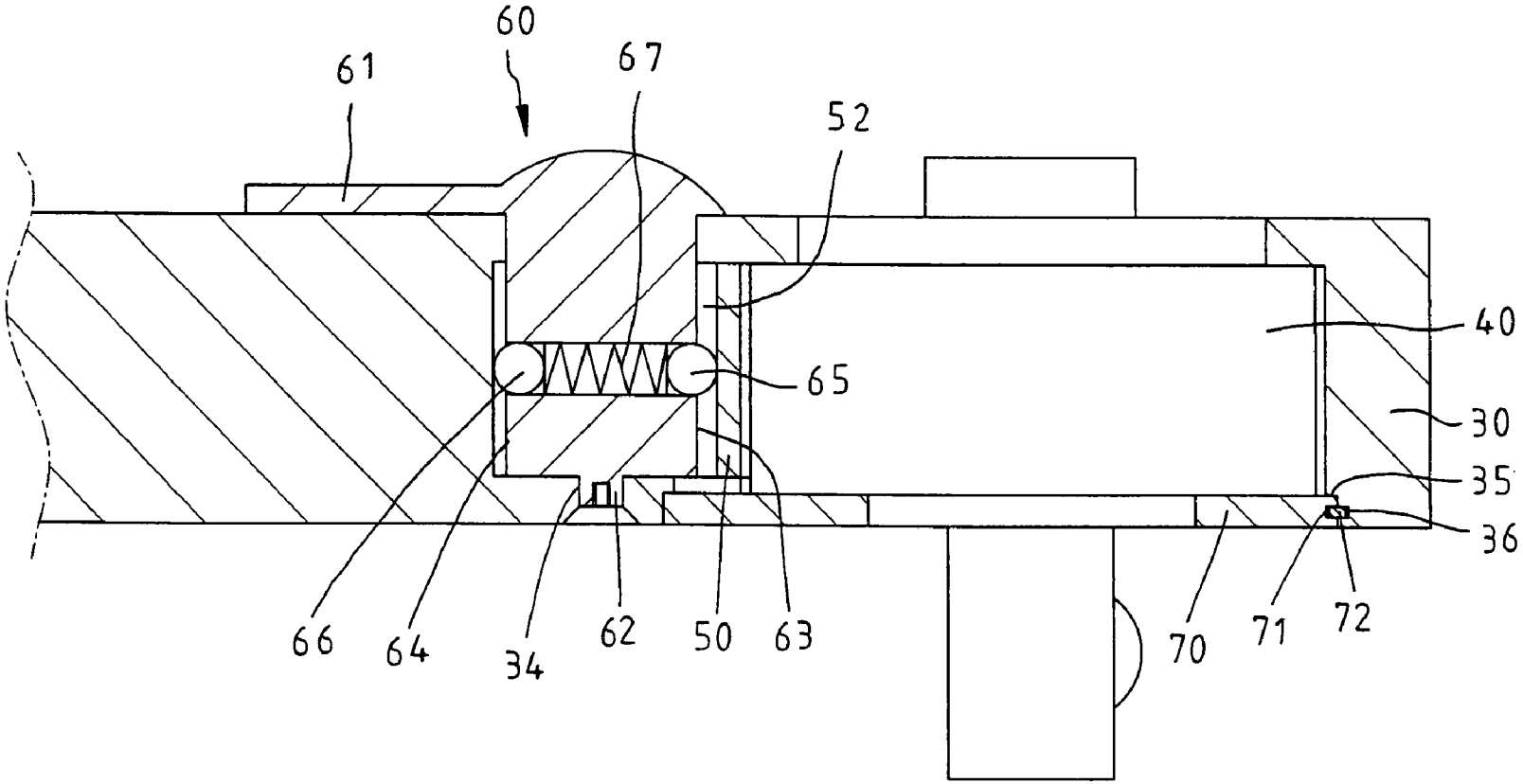
FIG. 7 is a cross-sectional view of the enclosed box portion shown in FIG. 6.
Figure 8:
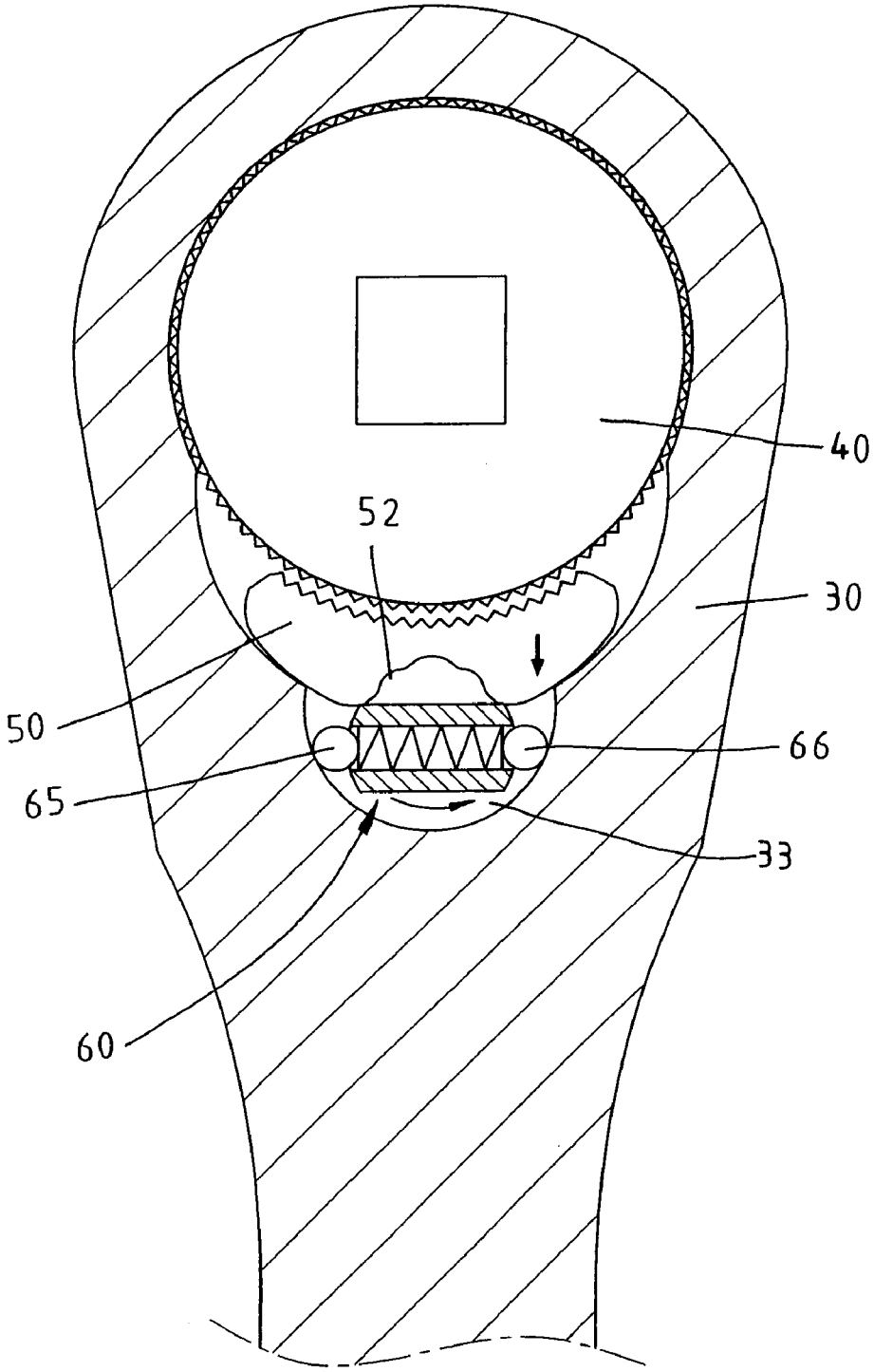
FIGS. 8, 9, and 10 are views similar to FIG. 6 for illustrating a direction change of exerted force by counterclockwise turning a swing assembly.

Referring to FIG. 8 in conjunction with FIGS. 5 and 6, a direction change of exerted force by counterclockwise turning the trigger member 61 of the swing assembly 60 is illustrated. As shown, one steel ball 65 disengages from the convex member 52 to be in contact with the wall of the second cavity 33, i.e., both convex members 52, 53 are engaged with the wall of the second cavity 33 and the pawl block 50 is disengaged from the ratchet wheel 40.

Figure 9:
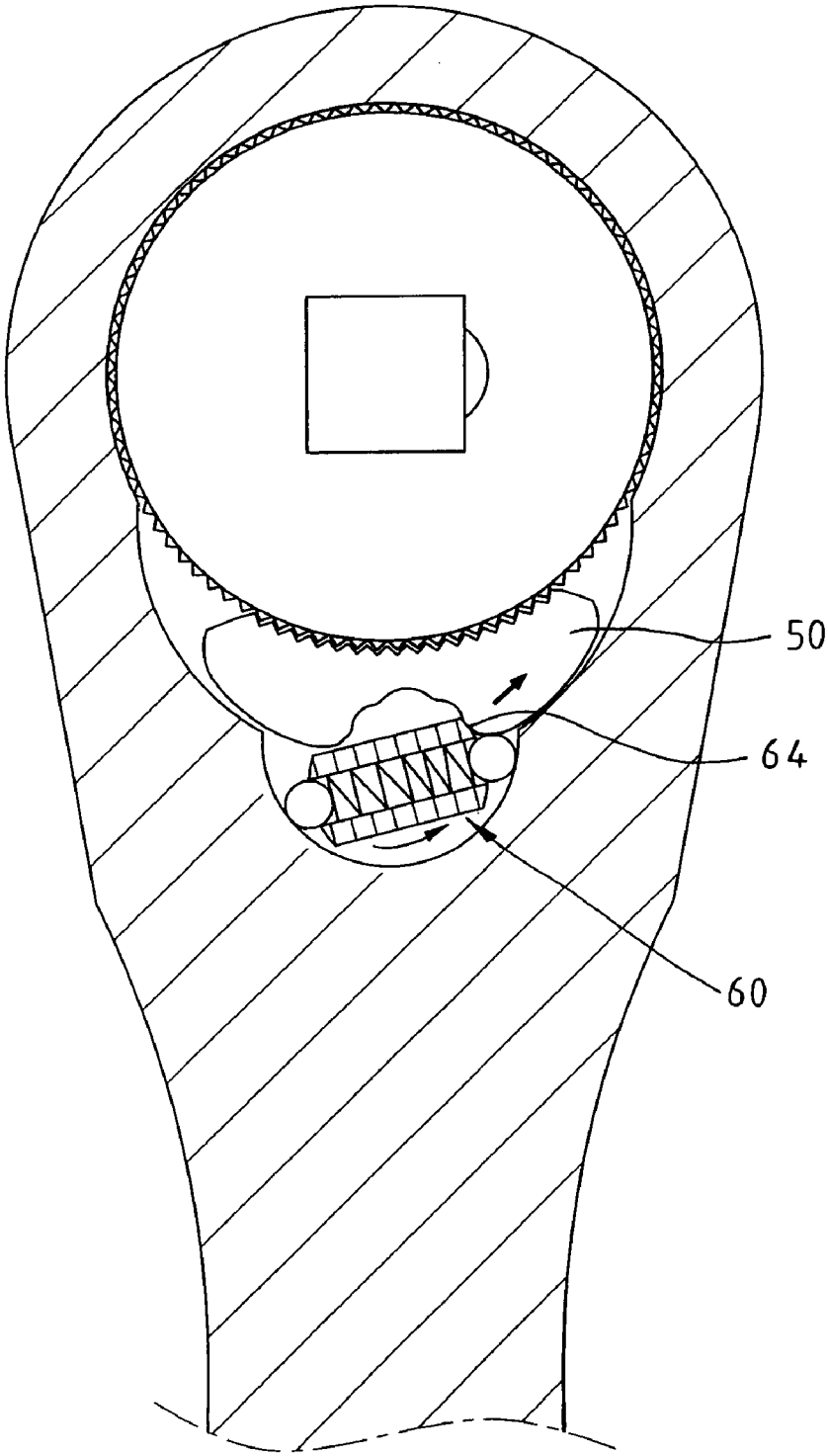
Figure 10:
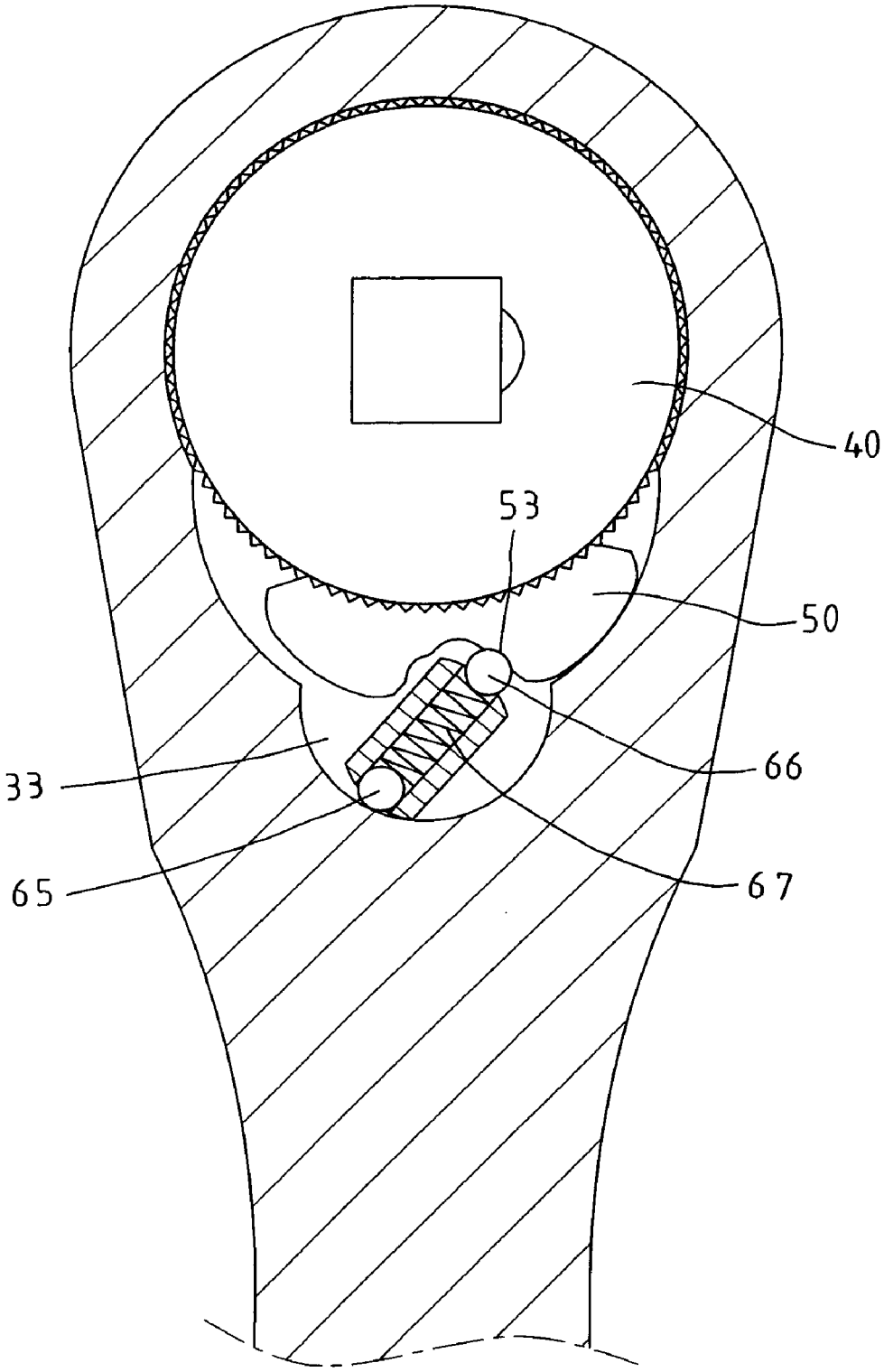

Referring to FIGS. 9 and 10, continuously counterclockwise turning the swing assembly 60 will engage the other steel ball 66 to contact the pawl block 50. The provision of the arcuate member 64 aims at facilitating the turning. The pawl block 50 then moves to engage with the ratchet wheel 40 while the other steel ball 66 moves to urge against the convex member 53 by the expansion of the spring 67. As an end, the purpose of direction change of exerted force of the wrench 30 is achieved.

Figure 11:
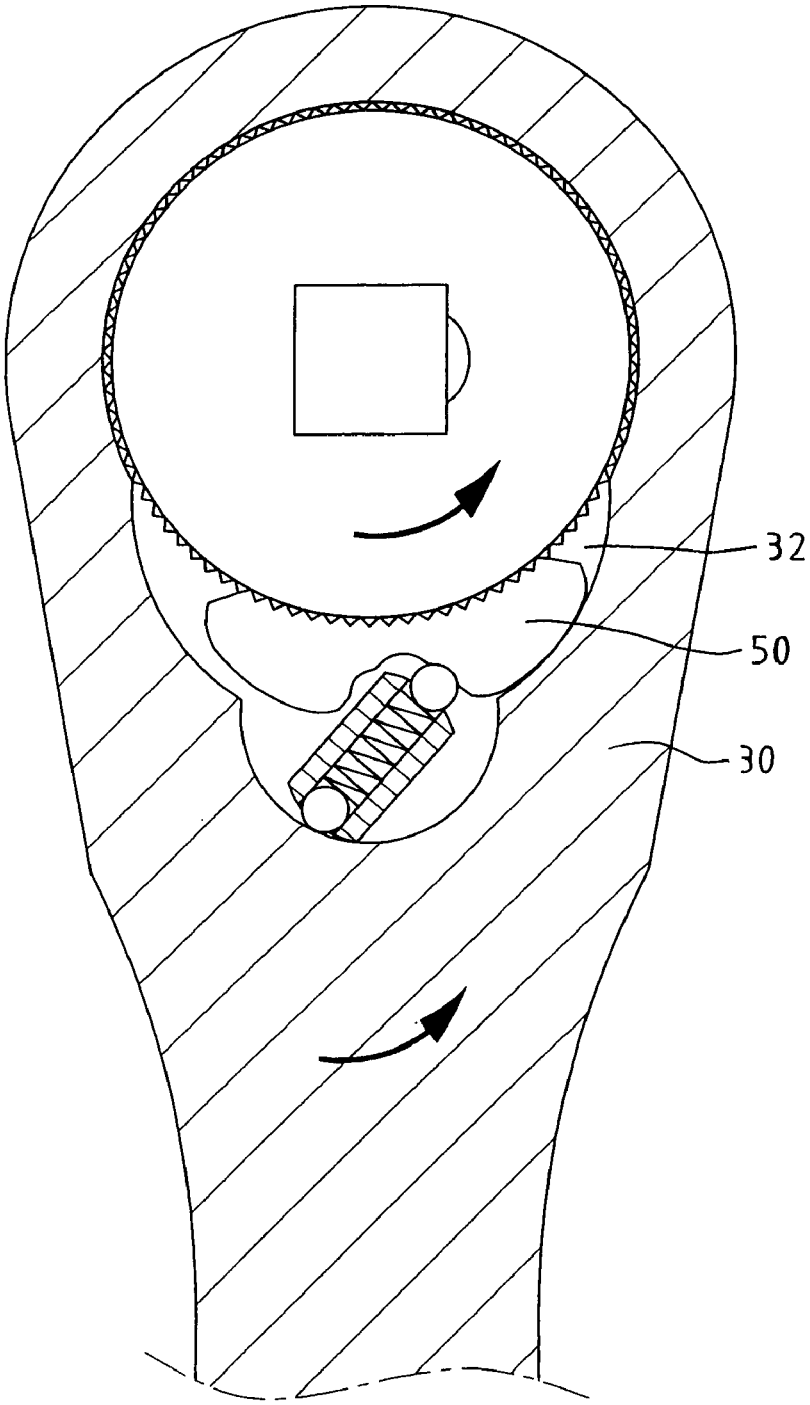
FIGS. 11 and 12 are views similar to FIG. 6 for illustrating a counterclockwise rotation and a clockwise rotation of the wrench respectively.

Referring to FIG. 11, a user may counterclockwise turn the wrench 30 in operation. Advantageously, substantially all force exerted by the wrench 30 is transferred to a thing to be fastened or unfastened since the side surface of the pawl block 50 is urged against the wall of the first cavity 32.

Figure 12:
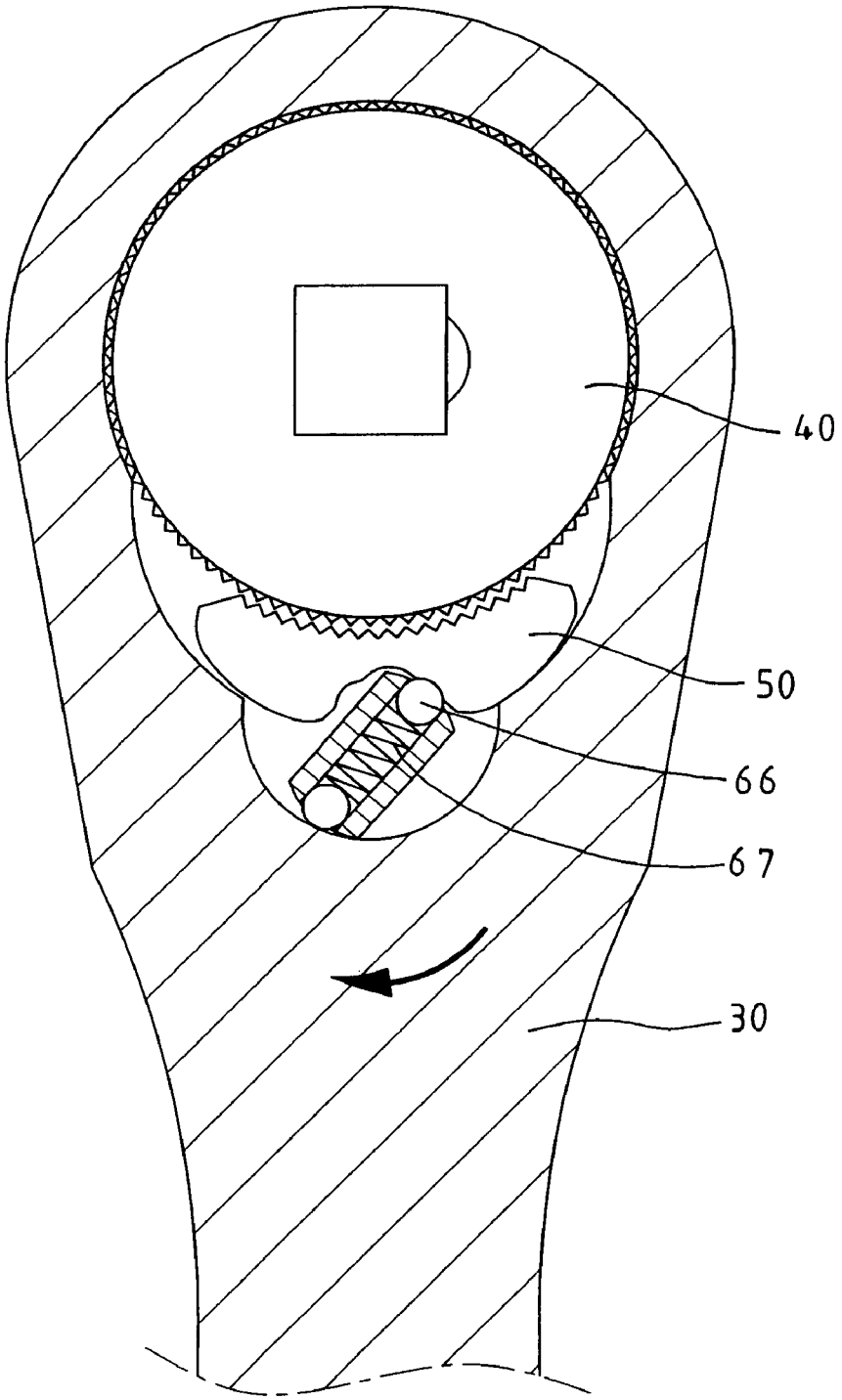

Referring to FIG. 12, alternatively a user may clockwise turn the wrench 30 to cause the ratchet wheel 40 to disengage from the pawl block 50 (i.e., the ratchet wheel 40 is inoperative). And in turn, the pawl block 50 compresses the steel balls 65, 66 and the spring 67. At this position, a user may adjust an angle of exerted force by the wrench 30 relative to the thing for a next operation.

Figure 13:
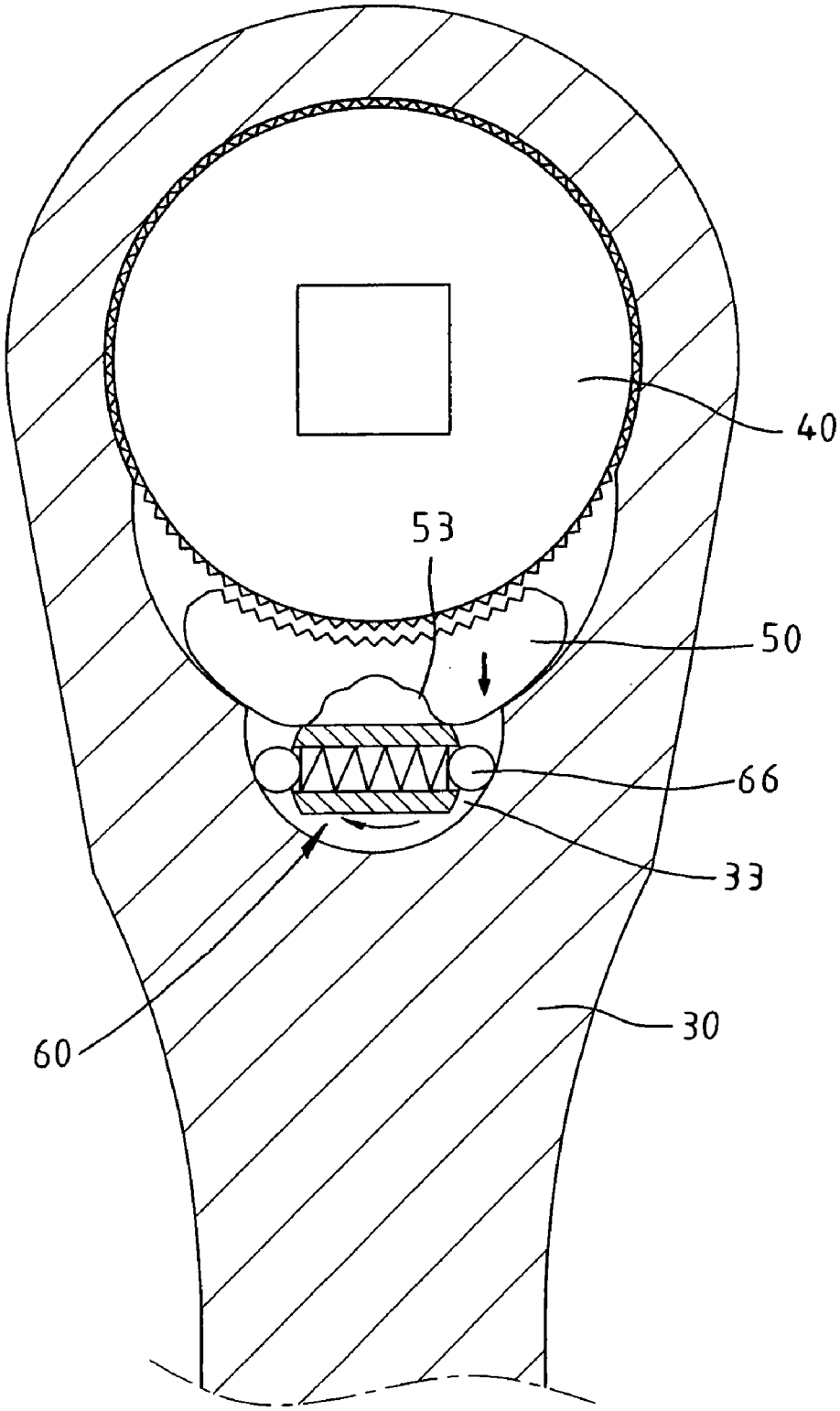
FIGS. 13, 14, and 15 are views similar to FIG. 6 for illustrating a reverse direction change of exerted force by clockwise turning the swing assembly.
Figure 14:
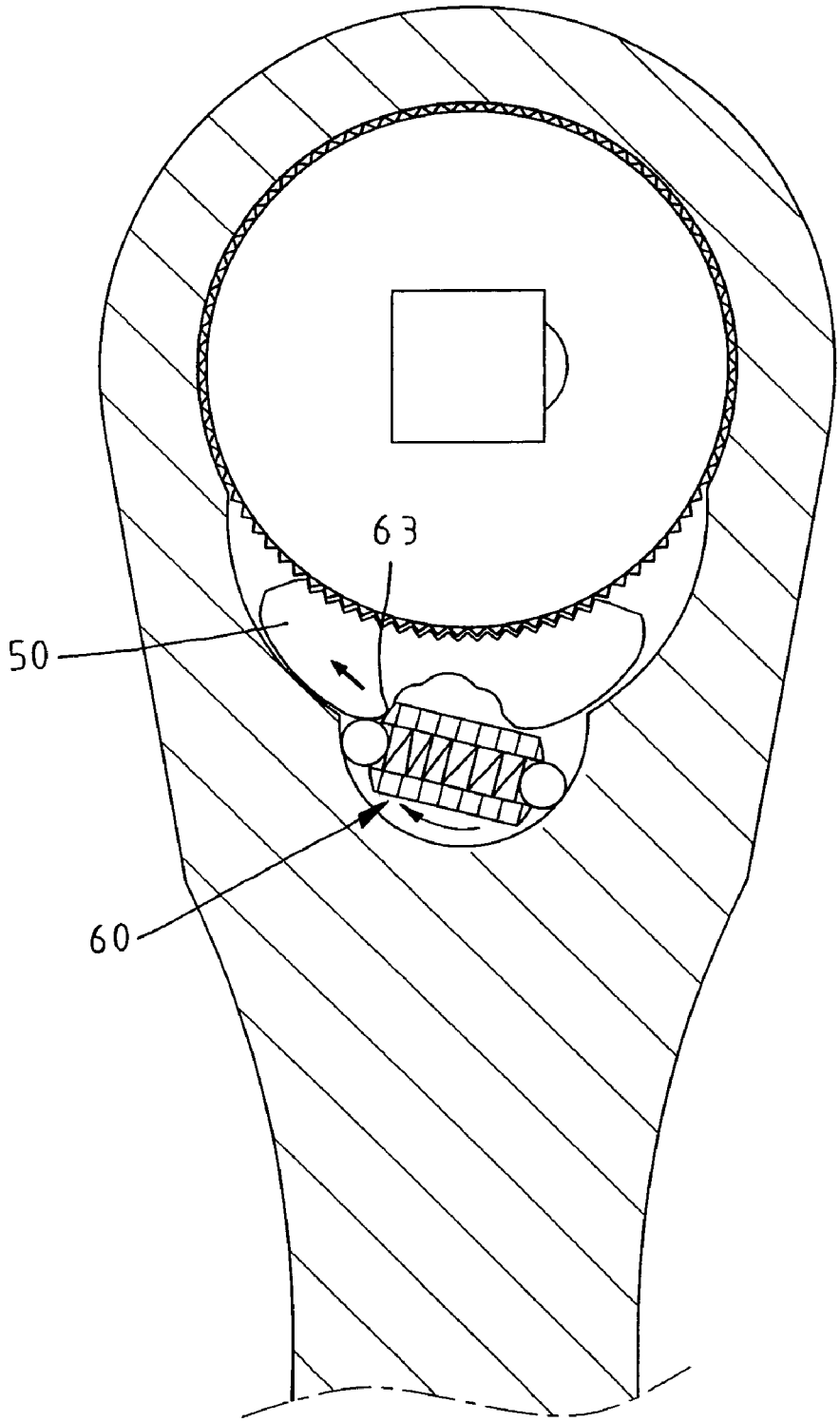
Figure 15:
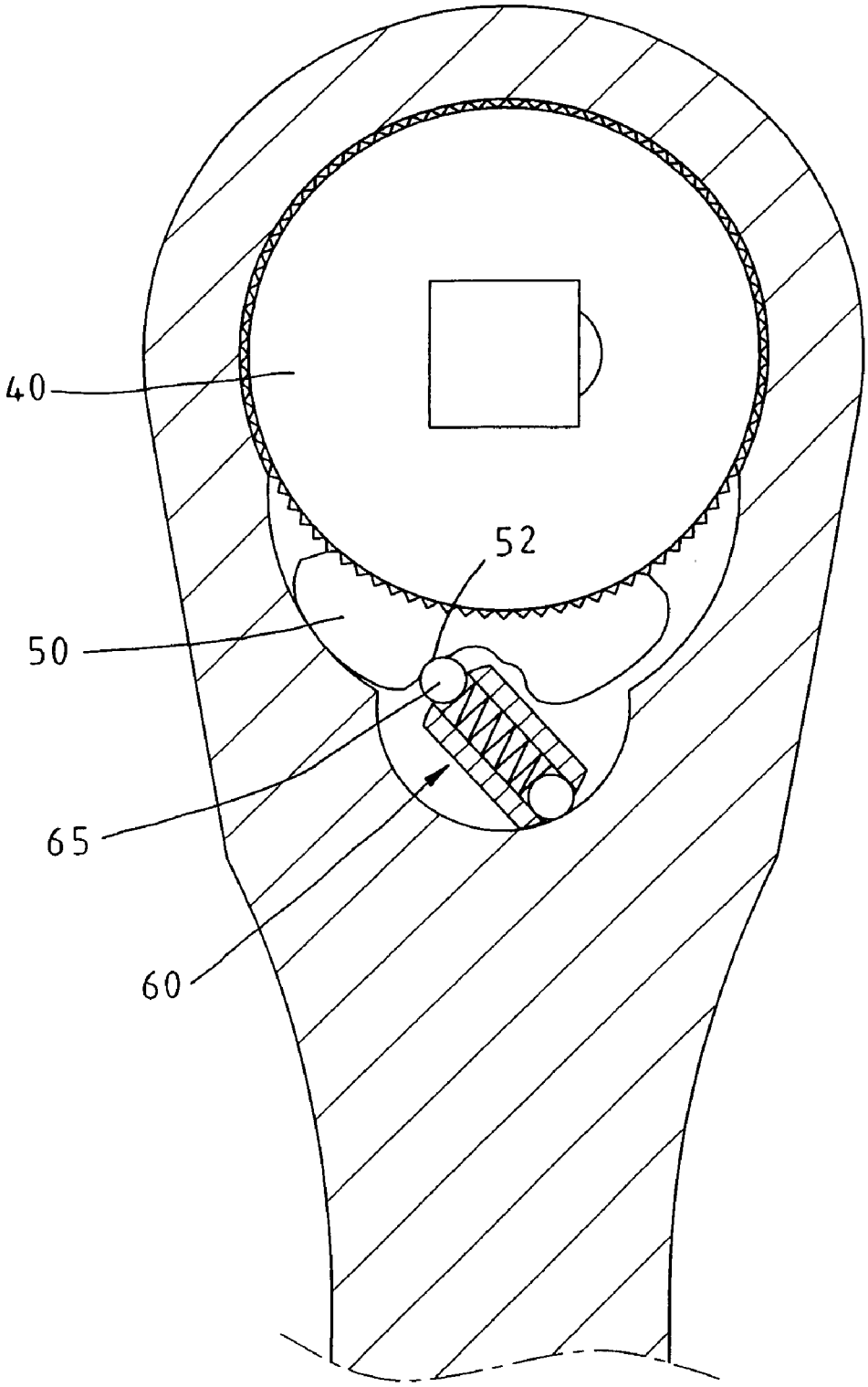

Referring to FIGS. 13 to 15, another direction change of exerted force (i.e., reverse to that shown in FIGS. 8 and 9) by clockwise turning the trigger member 61 of the swing assembly 60 is illustrated. As shown in FIG. 13, both steel balls 65, 66 are disengaged from the pawl block 50 and are engaged with the wall of the second cavity 33, and the pawl block 50 is disengaged from the ratchet wheel 40. Next, as shown in FIGS. 14 and 15, continuously clockwise turning the trigger member 61 of the swing assembly 60 will engage one steel ball 65 with the convex member 52. The pawl block 50 then moves to engage with the ratchet wheel 40. As an end, the purpose of reverse direction change of exerted force of the wrench 30 is achieved.

While the invention herein disclosed has been described by means of specific embodiments, numerous modifications and variations could be made thereto by those skilled in the art without departing from the scope and spirit of the invention set forth in the claims.

What is claimed is:

1. A wrench including an enclosed box portion, the enclosed box portion comprising:

a circular opening;

a C-shaped seat on a bottom of the circular opening, the C-shaped seat having a C-shaped groove and a diameter larger than that of the circular opening;

a substantially crescent first cavity disposed at one side of the circular opening and being in communication therewith;

a substantially half-circular second cavity adjacent a handle of the wrench and being in communication with the adjacent first cavity;

a ratchet wheel disposed in the circular opening;

pawl means disposed in the first cavity, the pawl means including a toothed section at one side and two continuous convex members at the other side;

an upright swing assembly fastened in the second cavity, the swing assembly including a trigger member on a top of the enclosed box portion, two arcuate members at opposite sides, a spring in a transverse hole, and two steel balls at both ends of the spring; and ring means including an annular recess and a flexible C-ring put on the recess, the ring means being fitted onto the seat with the recess being flush with the groove so that the C-ring is adapted to resiliently expand to dispose in both the recess and the groove for retaining the ratchet wheel in place, whereby counterclockwise turning the trigger member will disengage the steel balls from the convex members to be in contact with a wall of the second cavity and disengage the pawl means from the ratchet wheel; continuously counterclockwise turning the trigger member will bias one steel ball against one convex member for engaging the pawl means with the ratchet wheel, thereby causing the wrench to exert force toward a first direction; clockwise turning the wrench will cause the ratchet wheel to be inoperative, thereby adjusting an angle of the exerted force; clockwise turning the trigger member will disengage the steel balls from the pawl means to engage with the wall of the second cavity and disengage the pawl means from the ratchet wheel; and continuously clockwise turning the trigger member will bias the other steel ball against the other convex member for engaging the pawl means with the ratchet wheel, thereby causing the wrench to exert force toward a second direction opposite to the first direction.

2. The wrench of claim 1, further comprising a recessed aperture on a bottom of the enclosed box portion, the aperture being in communication with the second cavity.

3. The wrench of claim 2, wherein the swing assembly further comprises a cylindrical projection having inner threads inserted into the aperture for being adapted to fasten the swing assembly in the second cavity by driving a fastener into the projection.

* * * * *